US006826944B1

(12) United States Patent
Hagel

(10) Patent No.: US 6,826,944 B1
(45) Date of Patent: Dec. 7, 2004

(54) TRANSFER DEVICE AND METHOD FOR CONTROLLING A TRANSFER DEVICE

(76) Inventor: Hermann Hagel, Sauterleutestrasse 21, 88250 Weingarten (DE)

( * ) Notice: Subject to any disclaimer, the term of this patent is extended or adjusted under 35 U.S.C. 154(b) by 0 days.

(21) Appl. No.: 10/276,029

(22) PCT Filed: Jul. 19, 2000

(86) PCT No.: PCT/EP00/06910

§ 371 (c)(1),
(2), (4) Date: Apr. 1, 2003

(87) PCT Pub. No.: WO01/87512

PCT Pub. Date: Nov. 22, 2001

(30) Foreign Application Priority Data

May 12, 2000 (DE) ..... 100 23 241

(51) Int. Cl.[7] ..... B21D 43/05
(52) U.S. Cl. ..... 72/405.16; 198/621.1
(58) Field of Search ..... 72/405.16, 405.13, 72/405.01; 198/621.1

(56) References Cited

U.S. PATENT DOCUMENTS

| | | | | |
|---|---|---|---|---|
| 4,702,363 A | | 10/1987 | Sofy | |
| 5,307,666 A | | 5/1994 | Bianchi | |
| 5,423,202 A | | 6/1995 | Komatsu et al. | |
| 5,509,777 A | * | 4/1996 | Crorey et al. | 198/375 |
| 5,562,196 A | | 10/1996 | Zierpka et al. | |
| 5,586,464 A | | 12/1996 | Horde et al. | |
| 5,779,025 A | | 7/1998 | Dangelmayr et al. | |
| 6,024,530 A | | 2/2000 | Kleineisel et al. | |
| 6,073,551 A | | 6/2000 | Dangelmayr et al. | |
| 6,216,523 B1 | * | 4/2001 | Sofy et al. | 72/405.16 |

FOREIGN PATENT DOCUMENTS

| | | |
|---|---|---|
| DE | 22 06 407 | 8/1973 |
| DE | 39 33 775 A1 | 6/1990 |
| EP | 0 849 015 A2 | 6/1998 |
| EP | 0 650 781 B1 | 11/1998 |
| JP | 06031358 | 2/1994 |

* cited by examiner

*Primary Examiner*—Daniel C. Crane
(74) *Attorney, Agent, or Firm*—Wolf, Greenfield & Sacks, P.C.

(57) ABSTRACT

The invention relates to a transfer device having a gripper, preferably a gripper rail (13), for gripping and lifting at least one workpiece, a lift drive (26) for lifting the gripper, a close drive (20) for moving the gripper (12) sideways and a control element. The invention is characterized in that both drives (20, 26) are fixedly mounted and are constantly and exclusively meshing with the elements (16, 14) to be moved in an articulated manner. In a method for controlling a transfer device, at least one of the two drives is path controlled during the movement caused by the other drive in such a way that the element moved by one drive remains stationary in the direction of movement of said drive relative to the surroundings.

10 Claims, 2 Drawing Sheets

TRANSFER DEVICE AND METHOD FOR CONTROLLING A TRANSFER DEVICE

TECHNICAL FIELD

Figure 1:
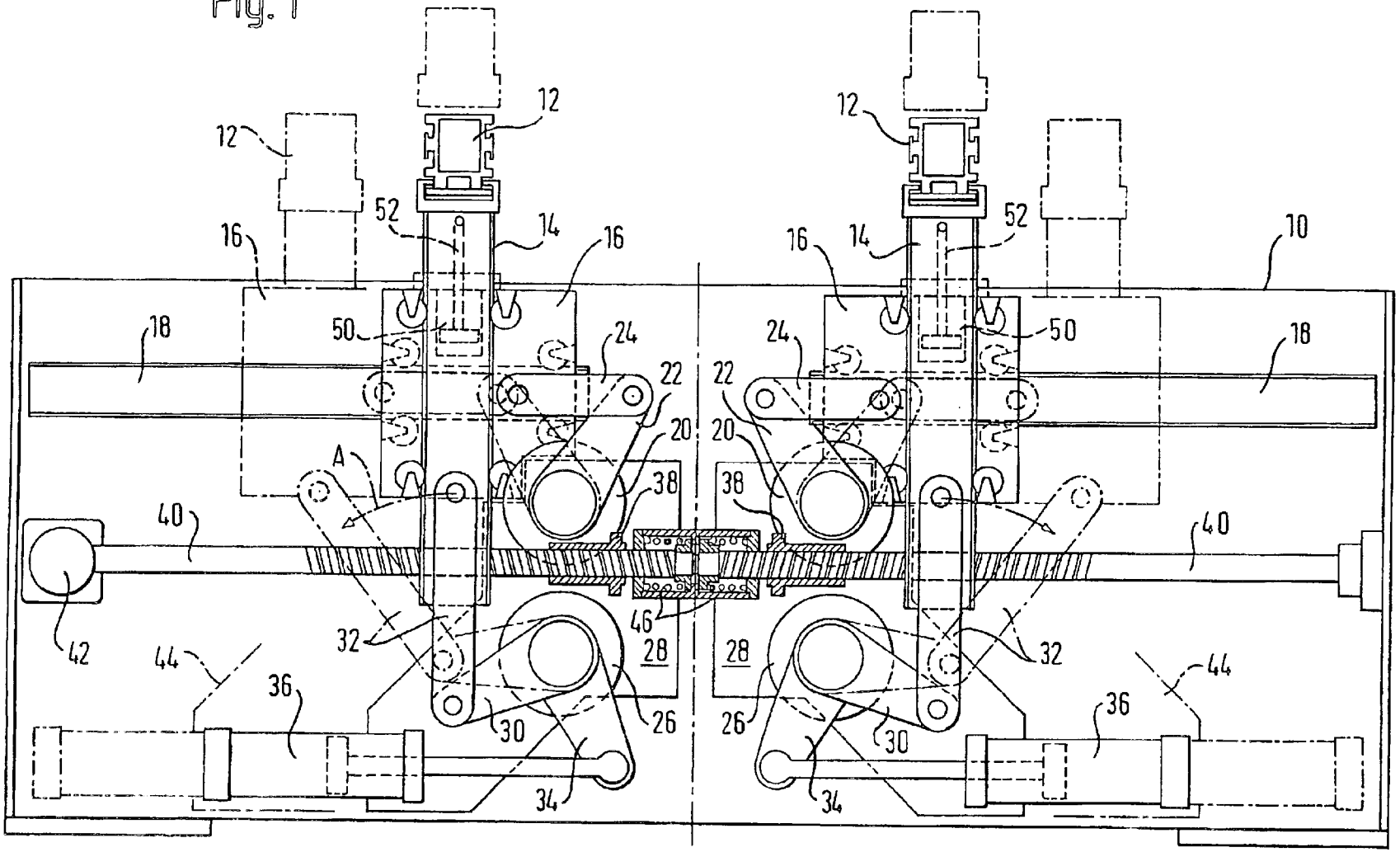

The invention relates to a transfer device according to the preamble of claim 1 and a method for controlling a transfer device according to the preamble of claim 6.

It is in particular known in the mass production of punch or press parts to use multistage presses, wherein one workpiece is subsequently moved through the individual stations of the press at which a certain processing is performed. The workpieces are gripped at all stations of the press, lifted, transferred and transported to the next station by so-called transfer devices during the opening lift of the press. Accordingly, it is required that a transfer device normally performs a movement of the workpieces in three subsequently following vertical moving directions. Starting from an open position, which the transfer device assumes when the lift of the press was just completed, the transfer device must close. This usually means that so-called gripper rails extending in the travel direction of the workpiece are moved towards the workpieces from both sides thereof, and catching fingers, which are usually provided at the gripper rails will grip the workpieces. Then, the gripper rails, and, thus, the workpieces are lifted in order to move them out of mesh from the processing tools. Thereupon follows the feed of all workpieces in the travel direction of the press. When all workpieces have reached the correspondingly next processing station, the gripper rails and, thus, the workpieces are lowered. Finally, the grippe rails open and return to their starting position by a movement opposite to the direction of feed, so that a new further transfer of all workpieces may follow after the end of the lift of the presses.

PRIOR ART

U.S. Pat. No. 5,307,666 discloses a transfer device which performs a movement with only two axes. The workpieces are gripped by a movement of the gripper rails towards each other and transferred to the next station by a movement in the direction of feed. No lifting is provided therein.

According to U.S. Pat. No. 5,586,464, the workpieces are additionally lifted, with the closing movement as well as the lifting movement of the gripper rails being performed by a common driving apparatus and by means of a cam mechanism.

In U.S. Pat. No. 5,423,202, the closing and the lifting of the gripper rails is carried out by separate driving apparatus. However, the driving apparatus for closing the gripper rails is situated on that component part which is lifted by the lift drive. This has the deficiency that the lift drive must be designed comparatively large. Further, the electric cables and the like, which lead to the closing drive, must be moved in each lifting movement and are therefore subject to considerable wear.

These disadvantages likewisely apply to the subject matter of EP 0 701 872 A1, in which a lift drive is also provided in order to lift the gripper rails together with the drives for the closing movement.

According to EP 0 849 015 A2, a ball bearing spindle is provided for the movement in one of the two required directions. Such a ball bearing spindle is, on the one hand, very noisy in operation. On the other hand, very high driving speeds are required for the rotation of the ball spindle which makes a complicated design of the drive necessary.

These disadvantages also apply to the arrangement according to DE 197 21 613 A1, in which the gripper rail is supported on parallel steerings which are rotatably attached to a slide. By a further slide having a lever which acts on one of the parallel steerings through a nut connected to the further slide a lifting of the gripper rails is effected by the rotation of a spindle.

JP-A-06031358 discloses a drive of a gripper element which has toothed racks and pinions. Herein, the lift drive must also be moved with the close drive in the close direction. A lifting is performed by moving the lift drive which is suitably connected to the gripper element by additional pinions and toothed racks.

DE 39 33 775 A1 discloses a device according to the preamble of claim 1 and a method according to the preamble of claim 6. The close drive is performed by a fixed cam disk through a suitable crank gear. The drive of the lift is also performed by a cam disk through a crank gear which is connected to a rail which is transversely arranged. A vertical guide column is shiftable supported at the upper end of which the gripper elements are situated.

SUMMARY OF THE INVENTION

The invention is based on the objective problem to create a transfer device and a method for controlling a transfer device, wherein the arrangement of the transfer device and, in particular, of the required drives may be designed in a particularly simple manner.

The solution of this objective problem is realized by the transfer device according to claim 1.

Accordingly, a lift drive for lifting the gripper rail, which is generally designated gripper, is provided, on the one hand. On the other hand, the transfer device according to the invention has a close drive for moving the gripper in lateral direction. In addition, a controller is provided, which is required for the connection according to the invention of both drives with the elements to be moved, which is explained in the following.

According to the invention, both drives are namely fixedly mounted, so that none of the two motors must be designed such that it must also drive the respective other drive mechanism apart from the parts to be moved. It is in particular not required that the lift drive must inter alia lift the close drive. Consequently, the drives may be designed comparatively small and compact which means a first simplification of the transfer device according to the invention and the reduction of the manufacturing costs. In addition, this arrangement offers the advantage that the electrical cables and the like which lead to the drives do not need to be moved during normal operation so that they do not need to be designed excessively wear-resistant either, which means a further reduction of cost.

As was stated above, it is conceivable with fixed drives that the engagement with the elements to be moved is performed via ball bearing spindles which have, however, certain disadvantages. Further, it is known to realize the transmission of the motion of rotation of an electromotor into the translational movement of the gripper rail via toothed racks and toothed belts. However, those belts must have an extremely great cross section in order that they are not excessively extended when loaded. This is required for a sufficiently precise movement without risk of vibrations and the like. Finally it would be conceivable to connect the lift drive with the part to be moved by means of an element, which is shiftably provided on a drive element of the motor. In this case, the lift drive remains in engagement with the element to be lifted also during the opening and closing movement. However, such a construction is comparatively complex.

According to the invention, it is provided that the two drives are constantly in engagement with the parts to be moved in an exclusively articulated manner. No additional ball bearing spindle is therefore provided, as it is the case with DE 197 21 613 A1. Rather, according to the invention, the transmission of the motion of rotation of the motor into a translational movement of the elements to be moved is realized in that a comparatively simple lever and bracket mechanism is provided the elements of which are connected with each other in an exclusively articulated manner. The required translational movement is realized by means of a suitable guidance of the parts to be moved. The described exclusively articulated connection of the respective drive to the element to be moved is comparatively simple to realize and is a further contribution to the simplification of the construction.

It should be mentioned that in view of the described connection between the two drive motors and the elements to be moved a compensation must take place such that the gripper rail is, for example, not lowered when it is opened. Based on the fact that a plunger guided in a travel carriage, which is e.g. vertically liftable and realizes the lifting movement of the gripper rail, is in a lowered position when the gripper rail is opened, and because of the circumstance that the plunger is constantly in an articulated engagement with the lift motor, the drive of the plunger will be moved when the gripper rail is opened in such a manner that the connecting bracket describes a section of an orbit so that its front end lowers. By the controller in accordance with the invention the lift drive can in this case be operated by means of a path control such that it compensates the actually occurring lowering movement of the plunger, in other words, that it somewhat lifts the plunger relative to the travel carriage, so that the gripper rail, as is desired, remains on the same horizontal level. Consequently, a comparatively simply designed transfer device can be realized with the invention, which at the same time meets the requirements. Besides, the basic idea of the invention can be seen in that a fixed mounting of both drives becomes possible by the above-explained tracking of the one drive during the movement of the gripper in the direction of movement of the other drive. The transmission of the movement of the respective drive to the element to be moved can however also be performed in another manner than that described above.

Preferred embodiments of the invention are described in further claims.

In principle, the type of mounting of the gripper relative to a stationary base may be designed at will. However, it has proved to be advantageous to support the gripper in a vertical direction liftable in a travel carriage which may sideways be moved. In this case, the above-described compensation movement will result.

It is a considerable advantage for operating the transfer device according to the invention, if the gripper is resiliently supported relative to a stationary base. This resilient bearing may in principle be provided directly at the gripper rail. However, the bearing may also be provided between a stationary element on which the travel carriage is guided, and a stationary base. So, a so-called adjusting carriage which is stationary in normal operation and whereon the travel carriage is guided, may, for example, be resiliently supported relative to the stationary base. The resilient bearing is preferably realized by means of a biased spring. This type of bearing offers the advantage that in case of malfunction the drives will be loaded to a smaller extent. The control of the close drive is usually provided such that it is path-controlled. If now for whatsoever reason a collision occurs, e.g. since a workpiece was wrongly positioned in the press, the controller will detect that the close motor is not on the programmed path in view of the speed, which occurs if the gripper rail collides with an element. If the close motor leaves the predetermined "window" of its speed path, it will usually immediately be braked, which, however, represents a high load to the components involved. If, however, as is preferably provided, the gripper rail is resiliently supported, the close motor may remain for a certain time on the predetermined path since the resilient bearing takes to a certain degree over the movement of the gripper rail which was prevented by collision. The fact that the close motor, based on work "against" the spring,—needs more force than usually which indicates an accident, may be detected by suitable detecting mechanisms which are obvious to those skilled in the art. In this situation it is however not inevitably necessary to brake the motor rapidly down to zero speed, but due to the resilient support braking may be performed in a manner somewhat more smooth and gentle. It should be noted that a contact-less end switch may alternatively or additionally be provided in order to stop the motor when a certain shifting of the resilient bearing is reached, which operation may however also be performed in a comparatively gentle manner.

As stated above, it is preferred within the scope of the invention that the so-called travel carriage is moveable supported on an adjusting carriage, which adjusting carriage itself is adjustable provided on a stationary base. The position of the (closed) gripper relative to the workpieces may be adjusted by the adjusting carriage. In particular, the distance of the gripper rail in the closed state may be adjusted in the usually occurring case that the workpieces are gripped from two opposite sides by parallel gripper rails. This allows to adapt the transfer device to different workpiece dimensions in a flexible manner. The transfer device according to the invention is flexibly usable by the provision of an adjusting carriage. In addition, it is advantageous that cables and the like leading to the drives must be moved comparatively rarely, namely only in case of adjustment of the adjusting carriage, so that they do not need to be designed in an unnecessary robust manner as this would be the case when the cables needed to be moved in each cycle.

It is further preferred that a force compensating mechanism is assigned to the lift drive. The force compensating mechanism essentially acts in a way that it receives the weight force in the lifting movement, so that the lift mechanism is in equilibrium with respect to the static forces and must only take over the dynamic load, i.e. must essentially overcome the forces of inertia and friction. In addition, the gear of the motor is correspondingly relieved. Consequently, the force compensating mechanism further contributes to simplify the transfer device.

The solution of the above-indicated objective problem is further realized by the method described in claim 6.

Accordingly, a transfer device is operated by means of a controller such that at least one of the two drives is path-controlled during the movement caused by the other drive in such a way, that the element moved by one drive remains stationary in the direction of movement of said drive relative to the surroundings. In the case that the plunger, through which the lifting movement of the gripper is carried out, is supported in the travel carriage, by means of which the opening and closing movement of the gripper is realized, for example the lift drive is path-controlled when opened and closed in such a manner that the height level of the gripper remains unchanged. It is self-evidently also conceivable that a lifting carriage is moveably supported on a stationary element and a sideways shiftable element is supported in this lift carriage. In this case, the close drive should follow-up such that the lateral positioning of the grippers is not changed and the workpieces safely remain in engagement. The measure according of the invention allows to arrange the drives in a fixedly mounted manner and that they are exclusively articulated in mesh with the elements to be moved via a comparatively simple lever and bracket mechanism. Consequently, by the method according to the invention, a particularly simple transfer device can also be realized.

The basic idea of the invention may thus be seen in that two translational movements in different directions are performed by stationary drives provided independently of each other, with a movement in the second direction not being performed if a movement in the first direction is performed and vice versa. This is obtained, as was explained, by the path-controlled follow-up of the drive which is not to be activated at a certain time.

Preferred embodiments of the method of the invention are described in the further claims.

In accordance with the embodiment of the transfer device previously described as being preferred, it is preferred within the scope of the method according to the invention that the lift drive is that drive which follows-up in a path-controlled manner in order to correct an lowering or lifting occurred.

In accordance with the embodiment of the transfer device previously described, wherein a resilient bearing of the gripper relative to the stationary base is provided, it offers advantages in the method according to the invention, if the lift drive has a force measuring sensor which is connected to the controller, and the controller detects an accident when the measured force surpasses a threshold. Thereby it is possible, as explained above, that an accident is reliably detected and handled with comparatively simple means such that a braking of the drives is performed in a manner which results in an acceptable load on the components involved.

SHORT DESCRIPTION OF THE DRAWINGS

Figure 2:
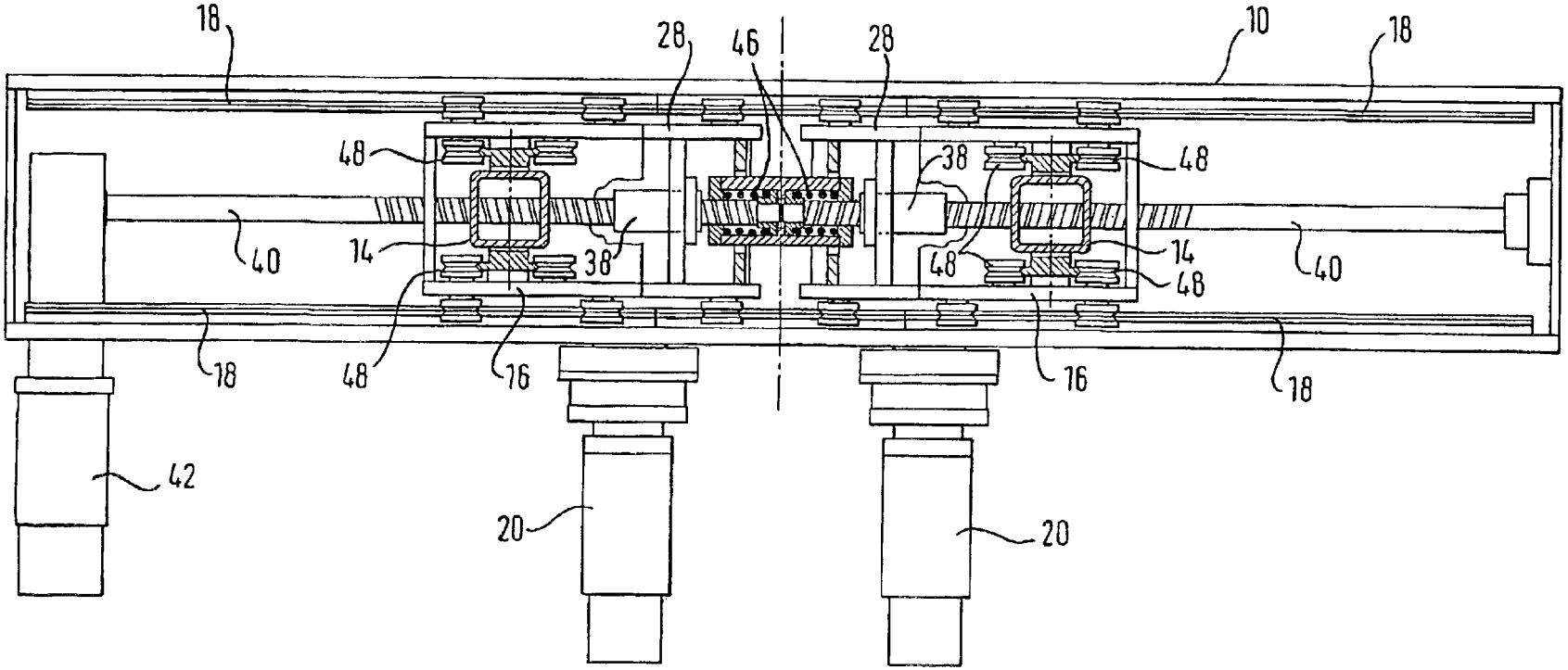

In the following, an embodiment of the invention is described by way of example by means of the drawings, wherein are:

FIG. 1 a front view of an essential portion of the transfer device according to the invention, and FIG. 2 a plan view onto the arrangement shown in FIG. 1.

DETAILED DESCRIPTION OF A PREFERRED EMBODIMENT OF THE INVENTION

The so-called close box 10 is shown in FIG. 1 as an essential part of the transfer device of the invention. The opening and the close movement as well as the lifting and lowering movement of the gripper rails are effected by means of two such close boxes 10 which are provided along the longitudinal extension of the gripper rails 12. It is understood that a feed is additionally provided at the transfer device of the invention which is commonly disposed on one end of the gripper rails and advances them in a direction vertically to the plane of the drawing of FIG. 1 in order to realize the feeding movement. For this purpose, the gripper rails 12 are shiftable supported on the plungers 14 in the direction of the feed. The workpieces which are held between the gripper rails in the close position thereof (shown with continuous lines) are moved in the direction of the feed by the feeding movement of the gripper rails 12. In particular they are transported in a multistage press to the respective next processing station. The workpieces must be gripped by the gripper rails prior to the feeding movement being performed.

The following explanations apply to the left side of the transfer device which is in principle symmetrical for the embodiments shown, in particular with respect to the direction of movement. It is understood that the directions of the right half are mirror-inverted.

Starting with a position in which the gripper rails 12 are open, i.e. lie outside (shown by broken lines in FIG. 1), the gripper rails 12 must be closed, so that they are then in the position shown by continuous lines. In the transfer device of the invention this closing movement is obtained by a travel of the so-called travel carriage 16 on a stationary guide 18 by means of rolls. The actuation of this so-called closing movement of the gripper rails 12 is performed by the close drive 20 being an electric motor. An output rotary element which may, if required, be attached to the motor via a gear is fixedly attached to a bracket 22. The bracket 22 performs an angular motion about the rotary axis of the motor 20. In order that slot openings and the like can be omitted in the connection to the travel carriage, the travel carriage 16 is connected to the bracket 22 in an articulated manner by means of a lever 24. It may be taken from FIG. 1 that the open position (shown as a broken line) is obtained in that the motor is operated counter-clockwisely, so that the bracket rotates counter-clockwisely and shifts the lever 24 as well as the travel carriage 16 according to FIG. 1 to the left side.

A lift drive 26 is provided independently of the close drive 20 and the accompanying bracket 22 and lever mechanism 24, which, like the close drive 20, is fixedly mounted to a so-called adjusting carriage 28 which remains stationary during normal operation. A bracket 30 is provided at the lift drive 26 in a similar manner as it is the case with the close drive 20, whereto a lever 32 is attached in an articulated manner which in turn is connected to the plunger 14 in an articulated manner.

As may easily be seen, a lifting of the plunger 14 and, thus, of the gripper rail 12 is possible in the close position shown by continuous lines, in that the lift drive 26 is rotated in a certain angular range in the clockwise direction, so that the bracket 30 also rotates in clockwise direction and presses the lever 32 and, thus, the plunger 14 upwards. The plunger 14 is supported in the travel carriage 16 on rolls and suitable guides with the possibility to be vertically lifted.

For sake of completeness it should be noted that the lift drive 26 is connected to a force compensation mechanism 36 via a further bracket 34 fixedly connected to its output rotary element which has the effect that it counteracts the weight load in particular of the plunger 14, the gripper rail 12 and the workpieces gripped thereby acting on the lever drive 26, so that the motor 26 as well as the gear usually used must only take up dynamic loads and friction forces. An alternative and presently preferred embodiment of such a force compensation mechanism is drawn into the area of the plunger 14 by broken lines. A cylinder 50 is supported on the travel carriage 16. The piston rod 52 projecting out of the cylinder is connected to the plunger 14. The cylinder 50 is designed such that it acts on the plunger 14 such that a force is applied to the plunger counteracting the weight load of the plunger, the gripper rail 12 and the workpieces. Since the weight loads, as mentioned, are already led off to the carriage 16 via the cylinder 50, not only a load alleviation of the motor and the gear is obtained by this design of a force compensation mechanism, as it is the case with the force compensation mechanism 36, but also a load alleviation of the bracket 30 and the lever 32 as well as of the connections involved.

In connection therewith it is understood that a corresponding compensation mechanism could also be provided in an embodiment, in which the travel carriage 16 is designed as lift carriage and a sideways shiftable plunger 14 is led in the lift carriage. This variant is obtained when the left half of FIG. 1 is turned by 90° in clockwise direction. An embodiment like this is designated short gripper transfer. In this case, the load on the lift motor could be alleviated in a corresponding manner. Alternatively, a load alleviation may be realized, as it is the case with the last described embodiment, at one element which is as close as possible to those elements the weight loads of which must be taken up. This allows also in this case to alleviate as may components of the transfer device according to the invention as possible.

The gripper rail is at first moved in one cycle of the transfer device according to the invention from the opened position (shown by broken lines at the outside) into the closed position (shown by continuous lines). In this position, usually a plurality of workpieces are gripped by special (not shown) catching fingers fastened to the gripper rail 12. The workpieces are lifted by subsequent actuation of the lift drive 26, and the gripper rails are moved by the feed (not shown) in a direction vertical to the plane of the drawing, so that each workpiece reaches the respectively next processing station. At this point the workpieces are lowered.

The particularity of the method of the invention becomes clear in the subsequent opening movement. When the travel carriage 16 is moved into the outer, open position, the hinge point, to which the lever 32 of the lift mechanism having the plunger 14 is connected, moves on an orbit in the direction of the arrow A, shown as a broken line. In more detail, the hinge point "would like" to move along this path, since the lift drive 26 and the bracket 30 fastened thereto are at this time at standstill, and the hinge point between bracket 30 and lever 32 forms a stationary center for the circular movement of the lever 32.

It may be seen that if the lever 32 would move along the orbit indicated by the arrow A, the connecting point with the plunger 14 would be lowered and, consequently, the plunger 14 would also be lowered. Usually, a movement like this cannot be allowed, since the gripper rail 12 or the plunger 14 would in this case collide with components of the press (not shown). For this reason, according to the invention, a compensation is provided in that the lift drive 26 is actuated such that the plunger 14 will not come down in spite of the movement of the travel carriage 16, but remains at the same level. This is shown in FIG. 1 by the broken line of the position of the bracket 30 which is approximately in the position "9o'clock". The required actuation of the lift drive 26 may be carried out by path-control with modern controllers such that it can be granted that the plunger 14 will not be lowered. Consequently, in the open position, the lever 32 obtains the position drawn by broken lines.

Although the path-controlled actuation of the lift drive 26 was above described in connection with the opening movement, it is understood that this must correspondingly be the reverse direction at the beginning of a new cycle. In other words, when the gripper rail 12 returned to its starting position by return movement of the feed, it will again be moved inwards into the closed position by the close drive 20. Since the lever 32 "would like" to move in this movement from the position in the orbit about the binding point with the bracket 30 (shown by broken lines), it must be granted by a suitable actuation of the lift drive, namely an actuation which would cause a lowering of the plunger 14 relative to the travel carriage 16 when the travel carriage is at standstill, that the horizontal position of the gripper rail 12 does not change.

It is further understood that the principle according to the invention has to be adapted in a suitable manner if the travel carriage is designed as lift carriage, which is in principle conceivable, in which a close plunger is guided which is sideways shiftable. In this case, based on the fixed mounting of the close drive and the hinged engagement with the close plunger, a shift of the close plunger in the lateral direction would be performed in a lifting movement. This shift may also be followed-up or corrected by a suitable path-controlled actuation of the close drive, so that the lateral shift of the gripper rails 12 is prevented in this case.

In addition to the described novel, exclusively articulated connection of the elements to be moved, which are constantly in engagement, i.e. the travel carriage 16 and the plunger 14 with the corresponding drive thereof, the embodiment of FIG. 1 provides that the distance between the two gripper rails 12 can be adjusted by means of the so-called adjusting carriage 28. For this purpose, a nut 38 is provided each at the adjusting carriage 28 which is driven by a spindle 40 by means of an adjusting motor 42 so that both adjusting carriages 28 move towards each other and away from each other, so that the distance between the gripper rails which they have when in the closed position may be adjusted. The respective adjusting carriage obtains the position which is shown by the broken line 44. It is understood that the force compensation mechanism 36 and all component parts attached to the adjusting carriage 28, i.e. essentially both drives 20 and 26, the travel carriage 16, the plunger 14 guided therein, as well as the respective bracket and lever mechanism, are catched. After the adjustment, the respective adjusting carriage 28 remains stationary when in the normal operation, so that the cables etc. led to the drives do not need to be moved and do not need to be provided with special protective measures. In addition to this, the motors may be designed comparatively small based on the fact that none of both motors must move the respective other motor.

A preferred measure of the embodiment shown may be seen approximately at the center plane of FIG. 1. The respective adjusting carriage 28 is resiliently supported relative to a stationary base by means of a preferably biased spring 46. As was explained above in connection with the description of the invention, this results in that the close drive 20 at first acts "against" the spring 46, if the gripper rail 12 collides with any component part prior to the actual engagement with the workpiece. As may easily be taken from FIG. 1, a further actuation of the close drive 20 will move the adjusting carriage 28 to the outside relative to a stationary base, when the gripper rails 12 meet resistance during their movement. The force required from the motor 20 may in this case be detected by a suitable sensor and processed by a controller such that an accident will be detected and the motor can smoothly be braked. If the close drive would not have a resilient bearing, it must immediately be stopped as soon as it detects that it is on the controlled speed path outside a certain tolerance window, since otherwise damages could be caused. However, such an abrupt stop is very destructive to the components involved. The resilient bearing of the adjusting carriage 28 shown relative to a stationary base, which may also be provided at another element, e.g. at the gripper rail 12 relative to the plunger 14, overcomes this problem.

The close box 10 according to FIG. 2 may additionally be seen in the plane view of FIG. 2. From the plane view may be taken that the two adjusting carriages 28 and the travel carriages 16 as well are moveable guided on two parallel rails, and that they travel thereon by means of a plurality of rolls which may have e.g. V-shaped indentations. In a similar manner, this also applies to the plunger 14 which is respectively liftable in the vertical direction, i.e. vertically to the plane of the drawing of FIG. 2, in the travel carriage 16.

As may be taken from FIG. 2, in the embodiment shown the plunger 14 is provided with a guide on both sides, which is approximately V-shaped, so that it is guided with the required precision in complementary designed rolls 48, which are fixed to the respective travel carriage 16 with the possibility of rotation. The two close drives 20 may further be taken from FIG. 2, whereas the lift drives 26, disposed thereunder are covered and cannot be seen.

The adjusting drive 42 acting on the spindle 40 may further be taken from FIG. 2 which extends through both nuts 38 such that the two adjusting carriages 28, with each of which the spindle 38 is fixedly connected, are moved towards or away from each other when the spindle turns on the basis of the different thread pitches in different areas. The resilient bearing of the adjusting carriages 28 relative to a stationary base by means of the springs 46 may additionally be taken from the middle part of FIG. 2.

What is claimed is:

1. A transfer device, comprising:

at least one gripper for gripping and lifting at least one workpiece, a close drive for moving the gripper sideways, which is constantly and exclusively in an articulated manner in engagement with a first element to be moved, and a lift drive independent from the close drive for lifting the gripper, with both drives being fastened in a stationary manner, and a controller, characterized in that the lift drive is constantly and exclusively in an articulated manner in engagement with a second element to be moved, wherein the second element moves sideways with the first element and is vertically movable relative to the first element, and at least one of the two drives is path-controlled during the movement caused by the respective other drive in such a way, that the element moved by the one drive remains stationary in the direction of movement of said one drive relative to the surroundings.

2. The transfer device according to claim 1, characterized in that the gripper is vertically liftable guided in a sideways shiftable travel carriage.

3. The transfer device according to claim 1, characterized in that the gripper is resiliently supported relative to a stationary base.

4. The transfer device according to claim 1, characterized in that the gripper is supported on a sideways movable adjusting carriage, which carriage can be adjusted in a lateral direction for the adjustment of the gripper.

5. The transfer device according to claim 1, characterized in that a force compensating mechanism is assigned to the lift drive.

6. A method for controlling a transfer device, comprising a gripper for gripping and lifting at least one workpiece, a close drive for moving the gripper sideways, which is constantly and exclusively in an articulated manner in engagement with a first element to be moved, a lift drive for lifting the gripper, with both drives being fastened in a stationary manner, and a controller, characterized in that the lift drive constantly and exclusively in an articulated manner engaging with a second element to be moved, wherein the second element moves sideways with the first element and is vertically movable relative to the first element, and path controlling at least one of the two drives during the movement caused by the respective other drive in such a way, that the element moved by the one drive remains stationary in the direction of movement of said one drive relative to the surroundings.

7. The method according to claim 6, characterized in that the lift drive is controlled during opening and closing such that the height position of the gripper remains unchanged.

8. The method according to claim 6, characterized in that the lift drive has a force measuring sensor which is connected to the controller, and that the controller detects an accident, if the measured force surpasses a limiting value.

9. The transfer device according to claim 1, wherein the gripper comprises a gripper wall.

10. The transfer device according to claim 1, wherein the gripper is resiliently supported relative to a stationary base by means of a biased spring.

* * * * *

UNITED STATES PATENT AND TRADEMARK OFFICE

CERTIFICATE OF CORRECTION

PATENT NO. : 6,826,944 B1
DATED : December 7, 2004
INVENTOR(S) : Hermann Hagel

It is certified that error appears in the above-identified patent and that said Letters Patent is hereby corrected as shown below:

Column 10,
Line 45, "wall" should read -- rail --.

Signed and Sealed this

Fifth Day of April, 2005

JON W. DUDAS
*Director of the United States Patent and Trademark Office*